US009366980B2

(12) United States Patent
Li et al.

(10) Patent No.: US 9,366,980 B2
(45) Date of Patent: Jun. 14, 2016

(54) METHOD FOR MAKING COLOR TONER

(71) Applicant: Xerox Corporation, Norwalk, CT (US)

(72) Inventors: Shigeng Li, Penfield, NY (US); Peter V Nguyen, Webster, NY (US); Judith M Vandewinckel, Livonia, NY (US); Amy A Grillo, Rochester, NY (US); Chieh-Min Cheng, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/540,284

(22) Filed: Nov. 13, 2014

(65) Prior Publication Data

US 2016/0139520 A1 May 19, 2016

(51) Int. Cl.

| | |
|---|---|
| ***G03G 9/08*** | (2006.01) |
| ***B01F 3/08*** | (2006.01) |
| ***B01F 1/00*** | (2006.01) |

(52) U.S. Cl.
CPC ..... *G03G 9/0804* (2013.01); *B01F 1/00* (2013.01); *B01F 3/0807* (2013.01); *B01F 2215/005* (2013.01)

(58) Field of Classification Search
CPC ..... G03G 9/0804
See application file for complete search history.

(56) References Cited

U.S. PATENT DOCUMENTS

| | | | | |
|---|---|---|---|---|
| 5,622,802 | A * | 4/1997 | Demizu | G03G 9/0804 430/108.1 |
| 2004/0009294 | A1* | 1/2004 | Kuribayashi | C09D 11/32 427/212 |
| 2012/0231386 | A1* | 9/2012 | Faucher | G03G 9/0804 430/108.4 |

* cited by examiner

*Primary Examiner* — Hoa V Le
(74) *Attorney, Agent, or Firm* — Marylou J. Lavoie, Esq. LLC

(57) ABSTRACT

A process for making colored polyester latex by phase inversion emulsification is described.

20 Claims, No Drawings

METHOD FOR MAKING COLOR TONER

FIELD OF THE INVENTION

The present disclosure relates to an improved method for producing colored toner avoiding the need for pigment dispersions by integrating hydrophobic colorant(s) in the mixture for preparing polyester resin particles. The polyester resin particles can be made by phase inversion emulsification (PIE). The colored resin particles then can be used to make toner. The processes disclosed herein increases latex production efficiency, enhances toner pigment loading, reduces the cost of latex manufacture and results in more efficient production of toner.

BACKGROUND

Latex emulsions of resins may be produced using PIE in which resins are dissolved in a mixture of water and organic solvent(s) (e.g., methyl ethyl ketone (MEK), isopropyl alcohol (IPA) or both) to form a homogenous water-in-oil (W/O) dispersion (i.e., water droplets dispersed in a continuous oil matrix). Subsequently, water is added to convert the dispersion into stable oil-in-water (O/W) latex (water as the continuous phase).

Organic solvent(s) is(are) removed (for example, by vacuum distillation), the resin particles can be washed, and surfactant and/or other reagents, such as, preservatives, may be added to provide a stable latex with high solid content. Such a latex may be used, for example, in emulsion aggregation (EA) methods for the production of toner particles (see, e.g., U.S. Pat. Nos. 5,853,943, 5,902,710; 5,910,387; 5,916,725; 5,919,595; 5,925,488, 5,977,210 and 5,994,020, and U.S. Pub. No. 2008/0107989, the entire disclosure of each of which hereby is incorporated by reference in entirety.)

Conventional pigments generally are hydrophobic and have to be dispersed in water with a surfactant to produce homogeneous dispersion for use in EA. But the dispersion of dry pigments increases cost, increases energy demand, prolongs cycle time and increases toner production cost.

It would be advantageous to develop processes that enhance latex production and toner production while reducing manufacturing cost that avoids the need to produce pigment dispersions.

SUMMARY

The instant disclosure describes an improved process of pigment incorporation or encapsulation in preparing polyester latex via phase inversion emulsification. The process comprises dissolving a hydrophobic colorant, such as, a pigment, in an organic solvent along with a polyester resin and performing PIE to produce colored polyester resin. The method avoids the need to disperse pigment in an aqueous solution using surfactant for use in a water-based process, such as, EA methods for making toner.

Many organic pigments can be dissolved in an organic solvent, such as, methyl ethyl ketone (MEK), which commonly is used in PIE to produce polyester latex. Hence, the subject matter of interest yields colored polyester resin which can be used to make toner.

DETAILED DESCRIPTION

Unless otherwise indicated, all numbers expressing quantities and conditions, and so forth used in the specification and claims are to be understood as being modified in all instances by the term, "about." "About," is meant to indicate a variation of no more than 10% from the stated value. Also used herein is the term, "equivalent," "similar," "essentially," "substantially," "approximating," and, "matching," or grammatic variations thereof, have generally acceptable definitions or at the least, are understood to have the same meaning as, "about."

As used herein, "commercial," relates to a scale of toner production greater than a bench scale and greater than a pilot scale. In terms of dry toner, a commercial scale of dry toner is produced in an amount of more than about 100 kg, more than about 200) kg, more than about 300 kg, more than about 400 kg, more than about 500 kg, more than about 600 kg, more than about 700 kg, more than about 800 kg, more than about 900 kg, more than about 1000 kg, more than about 1250 kg, more than about 1500 kg, more than about 1750 kg, more than about 2000 kg, more than about 2250 kg, more than about 2500 kg, more than about 2750 kg, more than about 3000 kg, more than about 3250 kg, more than about 3500 kg or more in a run. In the context of a batch reaction, a commercial production occurs in a reactor of at least about 1000 gal, at least about 1250 gal, at least about 1500 gal, at least about 1750 gal, at least about 2000 gal, at least about 2250 gal, at least about 2500 gal, at least about 2750 gal, at least about 3000 gal or more in size and amount.

Resins

Any resin may be utilized in forming a latex emulsion of the present disclosure. The resin may be a polyester resin, including the resins described, for example, in U.S. Pat. Nos. 6,593,049 and 6,756,176, the entire disclosure of each of which hereby is incorporated by reference in entirety, a styrene resin, an acrylate resin and so on. Suitable resins also may include a mixture of an amorphous polyester resin and a crystalline polyester resin as described in U.S. Pat. No. 6,830,860, the entire disclosure of which hereby is incorporated by reference in entirely. Suitable resins may include a mixture of high molecular weight (HMW) and low molecular weight (LMW) resins.

The resin may be a polyester resin formed by reacting a polyol with a polyacid in the presence of an optional catalyst. The polyol may be, for example, selected in an amount of from about 40 to about 60 mole percent, from about 42 to about 55 mole percent, from about 45 to about 53 mole percent. The polyacid may be selected in an amount of, for example, from about 40 to about 60 mole percent, from about 42 to about 52 mole percent, from about 45 to about 53 mole percent.

Polycondensation catalysts may be utilized in forming either the crystalline or amorphous polyesters and include tetraalkyl titanates, dialkyltin oxides, such as, dibutyltin oxide, tetraalkyltins, such as, dibutyltin dilaurate, and dialkyltin oxide hydroxides, such as, butyltin oxide hydroxide, aluminum alkoxides, alkyl zinc, dialkyl zinc, zinc oxide, stannous oxide or combinations thereof. Such catalysts may be utilized in amounts of, for example, from about 0.01 mole percent to about 5 mole percent based on the starting diacid or diester used to generate the polyester resin.

The resin may be present, for example, in an amount of from about 1 to about 20 percent by weight of the toner components, from about 2 to about 15 percent by weight of the toner components. The resin may possess various melting points of, for example, from about 30° C. to about 120° C., from about 50° C. to about 90° C. The resin may have a number average molecular weight (Mn), as measured by gel permeation chromatography (GPC) of, for example, from about 1(000 to about 50,000, from about 2,000 to about 25,000, and a weight average molecular weight (Mw) of, for example, from about 2,000 to about 100,000, from about 3,000 to about 80,000, as determined by GPC. The molecular weight distribution (Mw/Mn) of the resin may be, for example, from about 2 to about 6, from about 3 to about 5.

One, two or more resins may be used. Where two or more resins are used, the resins may be in any suitable ratio (e.g., weight ratio), such as, of from about 1% (first resin)/99% (second resin) to about 99% (first resin)/1% (second resin), in embodiments, from about 10% (first resin)/90% (second resin) to about 90% (first resin)/10% (second resin).

A suitable toner of the present disclosure may include two amorphous polyester resins and a crystalline polyester resin. The weight ratio of the three resins may be from about 30% first amorphous resin/65% second amorphous resin/5% crystalline resin, to about 60% first amorphous resin/20% second amorphous resin/20% crystalline resin.

A suitable toner of the present disclosure may include at least two amorphous polyester resins, a high molecular weight resin and a low molecular weight resin. As used herein, an HMW amorphous resin may have an Mw of from about 35,000 to about 150,000, from about 45,000 to about 140,000, and an LMW amorphous resin may have an Mw of from about 10,000 to about 30,000, from about 15,000 to about 25,000. The weight ratio of the HMW and LMW resins may be from about 10% first amorphous resin/90% second amorphous resin, to about 90% first amorphous resin/10% second amorphous resin.

A resin may possess acid groups which, in embodiments, may be present at a terminus of a polymer. Acid groups include carboxylic acid groups and the like. The number of acid groups may be controlled by adjusting the materials utilized to form the resin and reaction conditions. Acids groups can be neutralized using a basic agent to facilitate use, such as, solubilization. A resin may have an acid number from about 2 mg to about 200 mg KOH/g of resin, from about 5 mg to about 50 mg, from about 10 mg to about 15 mg KOH/g of resin.

Other suitable resins that can be used to make toner comprise a styrene, an acrylate, such as, an alkyl acrylate, such as, methyl acrylate, ethyl acrylate, butyl acrylate, isobutyl acrylate, dodecyl acrylate, n-octyl acrylate, n-butylacrylate, 2-chloroethyl acrylate; β-carboxy ethyl acrylate (β-CEA), phenyl acrylate, methacrylate, butadienes, isoprenes, acrylic acids, acrylonitriles, styrene acrylates, styrene butadienes, styrene methacrylates, and so on, such as, methyl α-chloroacrylate, methyl methacrylate, ethyl methacrylate, butyl methacrylate, butadiene, isoprene, methacrylonitrile, acrylonitrile, vinyl ethers, such as, vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as, vinyl methyl ketone, vinyl hexyl ketone, methyl isopropenyl ketone and the like; vinylidene halides, such as, vinylidene chloride, vinylidene chlorofluoride and the like; N-vinyl indole, N-vinyl pyrrolidone, methacrylate, acrylic acid, methacrylic acid, acrylamide, methacrylamide, vinylpyridine, vinylpyrrolidone, vinyl-N-methylpyridinium chloride, vinyl naphthalene, p-chlorostyrene, vinyl chloride, vinyl bromide, vinyl fluoride, ethylene, propylene, butylene, isobutylene and mixtures thereof. A mixture of monomers can be used to make a copolymer, such as, a block copolymer, an alternating copolymer, a graft copolymer and so on.

Solvent

Any suitable organic solvent may be used to dissolve a resin and a hydrophobic colorant, such as, a pigment, for example, alcohols, esters, ethers, ketones, amines and combinations thereof, in an amount of, for example, from about 30% by weight to about 400% by weight of the resin, from about 40% by weight to about 250% by weight of the resin, from about 50% by weight to about 100% by weight of the resin.

Suitable organic solvents include, for example, methanol, ethanol, propanol, IPA, butanol, ethyl acetate, MEK and combinations thereof. In embodiments, the organic solvent may be immiscible in water and may have a boiling point of from about 30° C. to about 120° C., which can be selected to be lower to enhance removal following latex formation, such as lower than the Tg of the resin(s). In embodiments, when at least two solvents are used, the ratio of solvents can be from about 1:2 to about 1:15, from about 1:2.5 to about 1:12.5, from about 1:3 to about 1:10, although other ratios can be used as a design choice.

Neutralizing Agent

A resin optionally may be mixed with a weak base, buffer or a neutralizing agent. In embodiments, the neutralizing agent may be used to neutralize acid groups in the resins, so a neutralizing agent, no matter the source or content, herein also may be referred to as a, "basic neutralization agent," or a, "basic agent." Any suitable basic neutralization reagent may be used in accordance with the present disclosure. Suitable agents may include inorganic basic agents and organic basic agents. Suitable basic agents may include ammonium hydroxide, potassium hydroxide, sodium hydroxide, sodium carbonate, sodium bicarbonate, lithium hydroxide, potassium carbonate, combinations thereof and the like.

Utilizing the above basic neutralization agent in combination with a resin possessing acid groups, a neutralization ratio of from about 25% to about 3%/o may be achieved, from about 50% to about 200%. In embodiments, the neutralization ratio may be calculated as the molar ratio of basic groups provided with the basic neutralizing agent relative to the acid groups present in the resin multiplied by 100%.

Addition of the basic neutralization agent may raise the pH of an emulsion including a resin possessing acid groups from about 5 to about 12, from about 6 to about 11. Neutralization of the acid groups may enhance formation of the emulsion.

An emulsion formed in accordance with the present disclosure includes a quantity of water, in embodiments, deionized water (DIW or DI water), in amounts and at temperatures that result in phase inversion and/or melt or soften the resin, of from about 25° C. to about 120° C., from about 35° C. to about 80° C.

Surfactants

Processes of the present disclosure may include adding a surfactant, for example, before or during combining reagents, for example, to the resin, optionally, at an elevated temperature, in an emulsion, in a dispersion and so on. The surfactant may be added prior to mixing the resin at an elevated temperature.

Surfactants may be employed in any desired or effective amount, for example, at least about 0.01% by dry or wet weight of reagents used to prepare the dispersion, at least about 0.1% by dry or wet weight of reagents used to prepare the dispersion; and no more than about 10% by dry or wet weight, no more than about 5% by dry or wet weight of the reagents used to prepare the dispersion, although the amount can be outside of those ranges.

Where utilized, a resin emulsion or a dispersion may include one, two or more surfactants. The surfactants may be selected from ionic surfactants and nonionic surfactants. Anionic surfactants and cationic surfactants are encompassed by the term, "ionic surfactants." In embodiments, the surfactant may be added as a solid or as a solution with a concentration of from about 5% to about 100% (pure surfactant) by weight, from about 10% to about 95% by weight.

Colorant

Various known colorants, such as pigments, dyes, or mixtures thereof, can be present in the toner in an effective amount of, for example, from about 1 to about 30 percent by weight of toner, or from about 2 to about 25, or from about 3 to about 20 percent by weight, that can be selected include black, cyan, violet, magenta, orange, yellow, red, green, brown, blue or mixtures thereof.

Examples of a black pigment include carbon black, copper oxide, manganese dioxide, aniline black, activated carbon, Regal 330, non-magnetic ferrite and magnetite and the like, and wherein the magnetites, especially when present as the only colorant component, can be selected in an amount of up to about 70 weight percent of the toner. However, in embodiments, the toner is non-magnetic.

Specific examples of blue pigment include Prussian Blue, cobalt blue, Alkali Blue Lake, Victoria Blue Lake, Fast Sky Blue, Indanethrene Blue BC, Aniline Blue, Ultramarine Blue, Calco Oil Blue, Methylene Blue Chloride, Phthalocyanine Blue, Phthalocyanine Green and Malachite Green Oxalate or mixtures thereof. Specific illustrative examples of cyans that may be used as pigments include Pigment Blue 15:1, Pigment Blue 15:2, Pigment Blue 15:3 and Pigment Blue 15:4, copper tetra(octadecyl sulfonamido)phthalocyanine, x-copper phthalocyanine pigment listed in the Color index as CI 74160, CI Pigment Blue, and Anthathrene Blue, identified in the Color index as CI 69810, Special Blue X-2137, and the like.

Examples of a green pigment include Pigment Green 36, Pigment Green 7, chromium oxide, chromium green, Pigment Green, Malachite Green Lake and Final Yellow Green G.

Examples of a red or magenta pigment include red iron oxide, cadmium red, red lead oxide, mercury sulfide, Watchyoung Red, Permanent Red 4R, Lithol Red, Naphthol Red, Brilliant Carmine 3B, Brilliant Carmine 6B, Du Pont Oil Red, Pyrazolone Red. Rhodamine B Lake, Lake Red C, Rose Bengal, Eoxine Red and Alizarin Lake. Specific examples of magentas that may be selected include, for example, Pigment Red 49:1, Pigment Red 81, Pigment Red 122, Pigment Red 185, Pigment Red 238, Pigment Red 269, Pigment Red 57:1, 2,9-dimethyl-substituted quinacridone and anthraquinone dye identified in the Color Index as CI 60710. CI Dispersed Red 15, diazo dye identified in the Color index as CI 26050, CI Solvent Red 19, and the like.

Examples of a violet pigment include manganese violet, Fast Violet B and Methyl Violet Lake, Pigment Violet 19, Pigment Violet 23, Pigment Violet 27 and mixtures thereof.

Specific examples of an orange pigment include Pigment Orange 34, Pigment Orange 5, Pigment Orange 13, Pigment Orange 16, and the like. Other orange pigments include red chrome yellow, molybdenum orange, Permanent Orange GTR, Pyrazolone Orange, Vulkan Orange, Benzidine Orange G, Indanethrene Brilliant Orange RK and Indanethrene Brilliant Orange GK.

Specific examples of yellow pigments are Pigment Yellow (PY) 17, Pigment Yellow 74, Pigment Yellow 83, Pigment Yellow 93, Yellow 180, Yellow 185, and the like. Other illustrative examples of yellow pigment include chrome yellow, zinc yellow, yellow iron oxide, cadmium yellow, chrome yellow, Hansa Yellow, Hansa Yellow 10G, Hansa Brilliant Yellow, Benzidine Yellow G, Benzidine Yellow GR, Suren Yellow, Quinoline Yellow, Permanent Yellow NCG, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

Examples of a white pigment include Pigment White 6, zinc white, titanium oxide, antimony white and zinc sulfide.

Colorants for use herein can include one or more pigments, one or more dyes, mixtures of pigment and dyes, mixtures of pigments, mixtures of dyes, and the like. The colorants are used solely or as a mixture.

Examples of a dye include various kinds of dyes, such as basic, acidic, dispersion and direct dyes, e.g., nigrosine, Methylene Blue, Rose Bengal, Quinoline Yellow and Ultramarine Blue.

A dispersion of colorant particles can be prepared by using a rotation shearing homogenizer, a media dispersing apparatus, such as a ball mill, a sand mill and an attritor, and a high pressure counter collision dispersing apparatus. The colorant can be dispersed in an aqueous system with a homogenizer by using a surfactant having polarity.

The colorant may be selected from the standpoint of hue angle, chroma saturation, brightness, weather resistance, overhead projector (OHP) transparency and dispersibility in the toner. In the case where the colorant particles in the toner have a median diameter of from 100 to 330 nm, the OHP transparency and the coloration property can be assured. The median diameter of the colorant particles can be measured, for example, by a laser diffraction particle size measuring apparatus (MicroTrac UPA 150, produced by MicroTrac Inc.)

Latex Processing

The present process comprises forming a mixture by any known means, optionally, at an elevated temperature above room temperature (RT), containing at least one resin, at least one hydrophobic colorant, at least one organic solvent, optionally a surfactant and optionally a neutralizing agent to form a colored polyester latex emulsion. The resin(s) may be preblended prior to combining or mixing. In embodiments, the elevated temperature for forming the mixture is near to or above the $T_g$ of the resin(s). In addition to a polyester, any other resin can be included, such as, an acrylate, a styrene and so on.

Thus, a process of the present disclosure may include contacting at least one polyester resin, at least one hydrophobic colorant, such as, a pigment, with an organic solvent to form a resin mixture, optionally heating the resin mixture to an elevated temperature, stirring the mixture, optionally adding a neutralizing agent to neutralize the acid groups of the resin, adding water until phase inversion occurs to form a phase inversed latex emulsion and removing solvent to produce a colored polyester latex, such as, with a low polydispersity, a lower percentage of fines, a lower percentage of coarse particles, a sculpted particle surface and so on. The colored latex can be washed, for example, with deionized water (DIW.)

In the phase inversion process, polyester resin may be dissolved in a low boiling point organic solvent, which solvent is miscible or partially miscible in water at a concentration of from about 1% by weight to about 75% by weight resin in solvent, from about 5% by weight to about 600% by weight resin in solvent. Colorant is added in an amount from about 0.1 wt % to about 20 wt %, from about 0.2 wt % to about 15 wt %, from about 0.3 wt % to about 10 wt %, although amounts outside of those ranges can be used. The resin mixture then can be heated to a temperature of from about 25° C. to about 90° C., from about 30° C. to about 85° C. The heating need not be held at a constant temperature, but may be varied. For example, the heating may be increased slowly or incrementally until a desired temperature is achieved.

Water can be added, for example, in two portions to form a uniform dispersion of colored polyester resin particles in water through phase inversion. Water may be added as a bolus or metered over time.

The organic solvents can be stripped through, for example, heating and/or vacuum distillation. The heating can be at a temperature elevated over the Tg of the resin(s) in the emulsion. The solvents can be selected to ensure ready removal at such a temperature, that is, solvents with boiling points below, at or near the Tg of the resin(s) can be selected for ready removal thereof from the emulsion.

In embodiments, the resin to solvent ratio may be from about 8:1 to about 3:1. When two solvents are used, and an LMW resin is included, the ratio of the LMW resin to the first and to the second solvents can be, for example, about 10:6:1.5. When an HMW resin is included with two solvents, the ratio of the HMW resin to the first and to the second solvents can be for example, about 10:8:2; although ratios different from those can be used.

The mixing temperature may be from about 35° C. to about 100° C., from about 40° C. to about 90° C., from about 50° C. to about 70° C.

Once the resin(s), colorant(s), optional neutralizing agent and optional surfactant are combined, the mixture then may be contacted with a first portion of a water, to form a W/O emulsion. Water may be added to form a latex with a solids content of from about 5% to about 60%, from about 10% to about 50%. While higher water temperatures may accelerate dissolution, latexes may be formed at temperatures as low as RT. In embodiments, water temperatures may be from about 40° C. to about 110° C., from about 50° C. to about 90° C.

The amount of water comprising the first portion of water is an amount suitable to form a W/O emulsion. Phase inversion can occur at about a 1:1 w/w or v/v ratio of organic phase to aqueous phase. Hence, the first portion of water generally comprises less than about 50% of the total volume or weight of the final emulsion. The first portion of water can be less than about 95% of the volume or weight of the organic phase, less than about 90%, less than about 85% or less of the volume or weight of the organic phase. Lower amounts of water can be used in the first portion so long as a suitable W/O emulsion is formed.

Phase inversion occurs on adding an optional aqueous alkaline solution or basic agent, optional surfactant and a second portion of water to create a phase inversed (O/W) emulsion including a dispersed phase including droplets possessing the molten ingredients of the resin composition and a continuous phase including the water.

Combining may be conducted, in embodiments, utilizing any means within the purview of those skilled in the an. For example, combining may be conducted in a glass kettle with an anchor blade impeller, an extruder, i.e., a twin screw extruder, a kneader, such as, a Haake mixer, a batch reactor or any other device capable of intimately mixing viscous materials to create near or homogenous mixtures. In embodiments, the reaction can occur in a microreactor or a continuous reactor of lower overall volume where materials are coursed through, for example, a cylindrical or tubular device at a certain and adjustable speed.

Stirring, although not necessary, may be utilized to enhance formation of the latex. Any suitable stirring device may be utilized. In embodiments, the stirring may be at a speed of from about 10 revolutions per minute (rpm) to about 5,000 rpm, from about 20 rpm to about 2,000 rpm, from about 50 rpm to about 1,000 rpm. The stirring need not be at a constant speed and may be varied. For example, as the heating of the mixture becomes more uniform, the stirring rate may be increased or decreased. In embodiments, a homogenizer (that is, a high shear device), may be utilized to form the phase inversed emulsion. Where utilized, a homogenizer may operate at a rate of from about 3,000 rpm to about 10,000 rpm.

Although the point of phase inversion may vary depending on the components of the emulsion, the temperature of heating, the stirring speed, and the like, phase inversion may occur when the optional basic neutralization agent, optional surfactant and water are added so that the resulting resin is present in an amount from about 5% by weight to about 70% by weight of the emulsion, from about 20% by weight to about 65% by weight, from about 30% by weight to about 60% by weight of the emulsion, and generally, when the water amount exceeds that of the organic solvent(s).

Following phase inversion, additional optional surfactant, water, and optional aqueous alkaline solution may be added to dilute the phase inversed emulsion.

Removal of solvent can be under reduced pressure, such as, below atmospheric pressure, below the vapor pressure(s) of the solvent(s) and so on. Removal can occur under elevated temperature.

Distillation with stirring of the emulsion can be performed under elevated temperatures and/or under vacuum to hasten solvent removal and to sculpt the particle surface. The elevated temperature is above the Tg or melting point of the resin(s) and/or about the boiling point of the solvent(s).

Heating may occur by application to the outer surface of the vessel carrying the emulsion, for example, using a jacket. The temperature of the jacket is the elevated temperature, that is, above the Tg of the resin(s). The heating device causes the walls of the vessel to adopt the elevated temperature, which then is passed to the emulsion contained in the vessel. Because the vessel contents are under agitation, generally, the fluid layer adjacent to the inner surface of the vessel adopts the elevated temperature of the heating means. The heat is passed to the central portion of the emulsion through mass action and any stirring, agitation, mixing and the like of the emulsion. Because the solvent near the periphery is the first to be heated to near, at or over the solvent(s) boiling point(s), those solvent molecules evaporate and that heat is carried in the vaporized solvent. The heat thus follows the vaporized solvent into the gaseous phase and reduces the temperature of the emulsion. The result is the overall batch temperature of the emulsion can be about 20° C. lower than the applied elevated temperature. The temperature of the heating device can be adjusted to obtain a desired average overall emulsion temperature in the batch reactor, at the levels described herein, depending on the resin(s) used, solvent(s) used and so on, as a design choice.

When conducted in a continuous reactor where materials are passed through a column or tube, for example, heating of the emulsion can be more uniform and removal of solvent and/or water more efficient.

When sufficient solvent is removed, which can be determined by known analytic techniques, such as, gas chromatography (GC), distillation is discontinued resulting in a latex. The aqueous liquid can be removed by known methods, such as, distillation, filtration, centrifugation and so on. Then, the particles are washed and so on, as known in the art. The polyester resin particles are produced more rapidly, are pigmented, are suitable for use in toner and are of a quality that facilitates and enhances toner production, particularly at a commercial scale.

The desired properties of the polyester resin emulsion (i.e., color, particle size, such as, less than about 300 nm, less than about 250 nm, less than about 200 nm, and low residual solvent level) may be achieved by adjusting the solvent and neutralizer concentration and process parameters (e.g., reactor temperature, vacuum and process time).

Toner

The resulting colored latex then may be utilized to form a toner by any method within the purview of those skilled in the art. The latex emulsion may be contacted with, for example, additional colorant, optionally in a dispersion, optionally, a wax, optionally in a dispersion, optionally another resin and other additives to form a toner by a suitable process, in embodiments, an EA and coalescence process.

Wax

Optionally, a wax also may be combined with the resin and an optional colorant in forming toner particles. The wax may be provided in a wax dispersion, which may include a single type of wax or a mixture of two or more different waxes.

When included, the wax may be present in an amount of, for example, from about 1% by weight to about 25% by weight of the toner particles, from about 5% by weight to about 20% by weight of the toner particles, although the amount of wax can be outside of those ranges. Waxes that may be selected include waxes having, for example, an average molecular weight of from about 500 to about 20,000, from about 1,000 to about 10,000.

Waxes that may be used include, for example, polyolefins, such as, polyethylene including linear polyethylene waxes and branched polyethylene waxes, polypropylene including linear polypropylene waxes and branched polypropylene waxes, polyethylene/amide, polyethylenetetrafluoroethylene, polyethylenetetrafluoroethylene/amide, naturally occurring waxes such as those obtained from plant sources or animal sources, and polybutene waxes. Mixtures and combinations of the foregoing waxes may also be used, in embodiments. In embodiments, the waxes may be crystalline or non-crystalline.

In embodiments, the wax may be incorporated into the toner in the form of one or more aqueous emulsions or dispersions of solid wax in water, e.g., where the solid wax particle size may be in the range of from about 100 to about 500 nm.

Toner Preparation

Toner compositions are prepared by EA processes, such as, a process that includes aggregating a mixture of a colored resin, an optional wax, any optional additional colorant and any other desired or required reagents, optionally comprising a surfactant. The pH of the resulting mixture may be adjusted by an acid such as, for example, acetic acid, nitric acid or the like, or a buffer. Additionally, in embodiments, the mixture may be homogenized. If the mixture is homogenized, that may be by mixing e.g., at about 600 to about 6,000 rpm. Homogenization may be accomplished by any suitable means, including, for example, an IKA ULTRA TURRAX T50 probe homogenizer.

Following preparation of the above mixture, an aggregating agent (or coagulant) may be added to the mixture. Any suitable aggregating agent may be utilized to form a toner. Suitable aggregating agents include, for example, aqueous solutions of a divalent cation or a multivalent cation material. The aggregating agent may be, for example, an inorganic cationic aggregating agent, such as, polyaluminum halides, such as, polyaluminum chloride (PAC), or the corresponding bromide, fluoride or iodide, polyaluminum silicates, such as, polyaluminum sulfosilicate (PASS), and water soluble metal salts, including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate and combinations thereof.

In embodiments, the aggregating agent may be added to the mixture at a temperature that is below the Tg of the resin. The aggregating agent may be added to the mixture utilized to form a toner in an amount of, for example, from about 0.1% to about 10% by weight, from about 0.2% to about 8% by weight, from about 0.3% to about 5% by weight, of the resin in the mixture.

The particles may be permitted to aggregate until a predetermined desired particle size is obtained. Particle size can be monitored during the growth process, for example with a COULTER COUNTER, for average particle size. The aggregation may proceed by maintaining the elevated temperature, or slowly raising the temperature to, for example, from about 4° C. to about 100° C., and holding the mixture at that temperature for a time of from about 0.5 hours to about 6 hours, from about 1 hour to about 5 hours, while maintaining stirring, to provide the aggregated particles. Once the desired size is reached, an optional shell resin can be added.

Shell

In embodiments, after aggregation, but prior to coalescence, a resin coating may be applied to the aggregated particles to form a shell thereover. Any resin described above or as known in the art may be utilized in the shell in any suitable amount.

The shell resin may be applied to the aggregated particles by any method within the purview of those skilled in the art. In embodiments, the resins utilized to form the shell may be in an emulsion, including any surfactant described above.

The formation of the shell over the aggregated particles may occur while heating to a temperature of from about 30° C. to about 80° C., from about 35° C. to about 70° C. Formation of the shell may take place for a period of time of from about 5 min to about 10 hr, from about 10 minutes to about 5 hours.

The shell may be present in an amount of from about 10% by weight to about 40% by weight of the latex particles, from about 20% by weight to about 35% by weight of the latex particles.

Once the desired final size of the toner particles is achieved, the pH of the mixture may be adjusted with a base or a buffer to a value of from about 3 to about 10, from about 5 to about 9. The adjustment of the pH may be utilized to freeze, that is, to stop, toner particle growth. The base utilized to stop toner growth may include any suitable base such as, for example, alkali metal hydroxides, such as, for example, sodium hydroxide, potassium hydroxide, ammonium hydroxide and the like, and combinations thereof. In embodiments, a chelator, such as, ethylene diamine tetraacetic acid (EDTA), may be added to help adjust the pH to the desired values.

Coalescence

Following aggregation to the desired particle size and application of any optional shell, the particles then may be coalesced to the desired final shape, the coalescence being achieved by, for example, heating the mixture to a temperature of from about 45° C. to about 100° C., from about 55° C. to about 95° C., which can be at or above the Tg of the resin(s) utilized to form the toner particles. Coalescence may be accomplished over a period of from about 0.01 to about 9 hours, from about 0.1 to about 4 hours.

After aggregation and/or coalescence, the mixture may be cooled to RT, such as, from about 20° C. to about 25° C. The cooling may be rapid or slow, as desired. A suitable cooling method may include introducing cold water to a jacket around the reactor. After cooling, the toner particles may be optionally washed with water and then dried. Drying may be accomplished by any suitable method for drying, including, for example, freeze-drying.

Additives

In embodiments, the toner particles may contain other optional additives, as desired or required. For example, the toner may include positive or negative charge control agents, for example, in an amount of from about 0.1 to about 10% by weight of the toner, from about 1 to about 3% by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the entire disclosure of which is hereby incorporated by reference in entirety; organic sulfate and sulfonate compositions, including those disclosed in U.S. Pat. No. 4,338,390, the entire disclosure of which is hereby incorporated by reference in entirety; cetyl pyridinium tetrafluoroborates; distearyl dimethyl ammonium methyl sulfate; aluminum salts, such as, BONTRON E84™ or E88™ (Orient Chemical Industries, Ltd.); combinations thereof and the like.

There can also be blended with the toner particles external additive particles after formation including, for example, flow aid additives, which additives may be present on the surface of the toner particles. Examples of the additives include metal oxides, such as, titanium oxide, silicon oxide, aluminum oxides, cerium oxides, tin oxide, mixtures thereof and the like; colloidal and amorphous silicas, such as, AEROSIL™, metal salts and metal salts of fatty acids inclusive of zinc stearate and calcium stearate, or long chain alcohols, such as, UNILIN 700, and mixtures thereof. Each of the external additives may be present in an amount of from about 0.1% by weight to about 5% by weight of the toner, from about 0.25% by weight to about 3% by weight of the toner, although the amount of additives can be outside of those ranges.

Toners of the present disclosure may be utilized as ultra low melt (ULM) toners comprising suitable resins of appropriate Tg, low melt wax and so on.

Dry toner particles, optionally having a shell, may, exclusive of external surface additives, have the characteristics: (1) volume average diameter (also referred to as "volume average particle diameter") of from e.g., about 3 to about 25 μm, from about 4 to about 15 μm, from about 5 to about 12 μm; (2) number average geometric size distribution (GSDn) and/or volume average geometric size distribution (GSDv) of from e.g., about 1.05 to about 1.55, from about 1.1 to about 1.4; and (3) circularity of from about 0.93 to about 1, from about 0.95 to about 0.99 (as measured with, for example, a Sysmex FPIA 2100 analyzer).

The characteristics of toner particles may be determined by any suitable technique and apparatus, such as, a Beckman Coulter MULTISIZER 3. The range and distribution of particle sizes can be so obtained. The particle distribution provides percentages of fine particles and of coarse particles, relative to particles of the desired mean size. A measure of the content of coarse particles is the $VD_{84}$ metric where coarse particles are those larger than the $84^{th}$ percentile in size. Another metric for assessing the content of coarse particles is the ratio, $VD_{84}/VD_{50}$. A measure of the content of fine particles is the $ND_{16}$ metric where fine particles are those smaller than the $16^{th}$ percentile in size. Another metric for assessing the content of fine particles is the ratio, $ND_{50}/ND_{16}$.

The toners may be used for electrostatographic or electrophotographic processes, including those disclosed in U.S. Pat. No. 4,295,990, the disclosure of which hereby is incorporated by reference in entirety. In embodiments, any known type of image development system may be used in an image developing device, including, for example, magnetic brush development, jumping single component development, hybrid scavengeless development (HSD) and the like. Those and similar development systems are within the purview of those skilled in the art.

Color printers commonly use four housings carrying different colors to generate full color images based on black plus the standard printing colors, cyan, magenta and yellow. However, in embodiments, additional housings may be desirable, including image generating devices possessing five housings, six housings or more, thereby providing the ability to carry additional toner colors to print an extended range of colors (extended gamut).

The subject matter now will be exemplified in the following non-limiting examples. Parts and percentages are by weight unless otherwise indicated.

EXAMPLES

Example 1

Polyester latexes can be produced using distillate from previous batches to complete the phase inversion emulsification (PIE) and then distilling the solvents, for example, MEK and IPA, under high vacuum. With reference to Table 1 detailing the reagents and the process, an HMW polyester resin with an acid value of 12.3 and a neutralization ratio of 90% was dissolved in a mixture of the dual solvents, DI water (I) and ammonia (I). The small quantity ammonia (I) is used to neutralize partially the polyester to promote dispersion within the mixture of organic solvents and DI water (I).

Ammonia (II) then is added to the homogenous resin dispersion further neutralizing acid end groups on polyester chains. Addition of DI water (II) generates a uniform aqueous suspension of polyester particles in a water continuous phase via phase inversion. The organic solvents remain in both the polyester particles and water phase. The solvents are removed via vacuum distillation during mixing at elevated temperatures.

TABLE 1

| Chemicals | Parts | Percentage (%) | Quantity (g) |
|---|---|---|---|
| HMW Resin* | 10 | 26.2 | 200 |
| MEK | 6 | 15.7 | 120 |
| IPA | 1.8 | 4.7 | 36 |
| Aq. Ammonia (I) | 0.11 | 0.3 | 2.20 |
| DI water (I) | 6.25 | 16.4 | 125 |
| Aq. Ammonia (II) | 0.22 | 0.6 | 4.40 |
| DI water (II) | 13.74 | 36.0 | 275 |
| Total | 38.12 | 100 | 762 |

Example 2

Using the formulation and process of Example 1, colored resins were prepared using varying, amounts of Pigment Yellow 74 (PY74). Thus, 0.5 g, 5 g and 10 g of PY74 were added to the formulation. For samples containing 5 g and 10 g of PY74, the amount of MEK was increased from 6 parts to 10 parts, and the amount of IPA was increased from 1.8 to 2 parts, see Table 2

TABLE 2

| Chemicals | Parts | Percentage (%) | Quantity (g) |
|---|---|---|---|
| HMW Resin | 10 | 23.4 | 200 |
| MEK | 10 | 23.4 | 200 |
| IPA | 2.5 | 5.8 | 50 |
| Aq. Ammonia (I) | 0.11 | 0.3 | 2.20 |
| DI water (I) | 6.25 | 14.6 | 125 |
| Aq. Ammonia (II) | 0.22 | 0.5 | 4.40 |
| DI water (II) | 13.74 | 32.1 | 275 |
| Total | 42.82 | 100 | 856 |

The PY74 was added and dissolved in the solvent mixture of MEK and IPA, and the DIW (I) for 5 min with aggressive mixing. Then, the resin was added to the reactor along with the first aliquot of base to form the polyester emulsion. After neutralization of polyester ammonia (II), another 275 g water (II) were added slowly to convert the resin dissolution into latex at 40° C. under aggressive agitation.

The slurry then was distilled under vacuum to remove solvent. Part of the product was centrifuged to isolate the latex particles from water, washed with water, and air-dried at room temperature for particle characterization.

Example 3

The particles of the control resin not containing PY74 and of the three samples of resins containing PY74 were of about the same size, as determined using a Nanotrac device. Hence, presence of the PY74 did not impact resin particle formation and size. Resin color correlated positively and directly with the amount of PY74 used. The PY74 particles were contained within the resin particles, on the resin particles or both.

It will be appreciated that variations of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material. Words, expressions, terms, symbols, etc. used herein unless defined explicitly or in context are understood to have meaning as generally used by those familiar with toner technology.

All references cited herein are herein incorporated by reference in entirety.

We claim:

1. A process of making a colored resin particles comprising:

(a) dissolving a pigment and a polyester resin in a mixture of water and at least one organic solvent to form a homogenous water-in-oil (W/O) dispersion; and (b) performing phase inversion emulsification by adding water to convert the water-in-oil dispersion into an oil-in-water emulsion comprising said colored resin particles.

2. The method of claim 1, wherein said organic solvent comprises methyl ethyl ketone (MEK), isopropyl alcohol (IPA) or mixture thereof.

3. The method of claim 1, wherein said resin further comprises a polystyrene resin, a polyacrylate resin or a combination thereof.

4. The method of claim 1, wherein said resin comprises an amorphous resin, a crystalline resin or both.

5. The method of claim 1, wherein said pigment comprises a yellow pigment.

6. The method of claim 1, wherein the pigment comprises pigment yellow 74.

7. The method of claim 1, wherein said resin comprises a high molecular weight resin, a low molecular weight resin or both.

8. The method of claim 1, wherein said dissolving, said performing or both are at an elevated temperature.

9. The method of claim 1, wherein pigment is present in an amount from about 0.1 wt % to about 20 wt %.

10. The method of claim 1, wherein said dissolving further comprises a neutralizing agent.

11. The method of claim 1, wherein said dissolving further comprise an ammonia.

12. The method of claim 1, further comprising separating organic solvent from said emulsion.

13. The method of claim 12, wherein said separating comprises distilling organic solvent.

14. The method of claim 1, further comprising:

(i) combining said colored resin particles with an optional wax and an optional surfactant, in the absence of additional colorant, to form a toner reagent emulsion;

(ii) incubating said toner reagent emulsion, optionally with an aggregating agent, to form aggregated particles;

(iii) treating said aggregated particles to halt growth thereof;

(iv) optionally treated said growth halted aggregated particles with a shell resin; and (v) optionally coalescing said particles of step (iii) or step (iv) to produce colored toner particles.

15. The method of claim 14, wherein said emulsion comprises an amorphous resin, a crystalline resin or both.

16. The method of claim 14, wherein said emulsion comprises a wax.

17. The method of claim 14, wherein said step (ii) comprises an aggregating agent.

18. The method of claim 14, wherein said aggregating particles are treated with a shell resin.

19. The method of claim 14, comprising coalescing said particles of step (iii).

20. The method of claim 14, comprising coalescing said particles of step (iv).

* * * * *